US009031274B2

(12) United States Patent
Kasic, II

(10) Patent No.: US 9,031,274 B2
(45) Date of Patent: May 12, 2015

(54) ADHESIVE BONE CONDUCTION HEARING DEVICE

(71) Applicant: Sophono, Inc., Boulder, CO (US)

(72) Inventor: James F Kasic, II, Boulder, CO (US)

( * ) Notice: Subject to any disclaimer, the term of this patent is extended or adjusted under 35 U.S.C. 154(b) by 3 days.

(21) Appl. No.: 13/804,420

(22) Filed: Mar. 14, 2013

(65) Prior Publication Data

US 2014/0064533 A1 Mar. 6, 2014

Related U.S. Application Data

(60) Provisional application No. 61/697,427, filed on Sep. 6, 2012.

(51) Int. Cl.
*H04R 25/00* (2006.01)
*H04R 5/033* (2006.01)

(52) U.S. Cl.
CPC ..... *H04R 25/60* (2013.01); *H04R 5/0335* (2013.01); *H04R 2460/13* (2013.01)

(58) Field of Classification Search
USPC ..... 381/324, 151
See application file for complete search history.

(56) References Cited

U.S. PATENT DOCUMENTS

| | | | |
|---|---|---|---|
| 4,352,960 | A | 10/1982 | Dormer et al. |
| 4,612,915 | A | 9/1986 | Hough et al. |
| 4,726,378 | A | 2/1988 | Kaplan |
| 4,736,747 | A | 4/1988 | Drake |
| RE23,947 | E | 6/1989 | Dormer |
| 4,918,745 | A | 4/1990 | Hutchison |
| 5,267,764 | A | 12/1993 | Hoffman |
| 5,558,618 | A | 9/1996 | Maniglia |
| 5,906,635 | A | 5/1999 | Maniglia |
| 6,246,911 | B1 | 6/2001 | Seligman |
| 6,358,281 | B1 | 3/2002 | Berrang et al. |
| 6,517,476 | B1 | 2/2003 | Bedoya et al. |
| 6,537,200 | B2 | 3/2003 | Leysieffer et al. |
| 6,565,503 | B2 | 5/2003 | Leysieffer et al. |
| 6,648,914 | B2 | 11/2003 | Berrang et al. |
| 7,186,211 | B2 | 3/2007 | Schneider et al. |
| 7,386,143 | B2 | 6/2008 | Easter et al. |
| 7,599,508 | B1 | 10/2009 | Lynch et al. |
| 7,856,986 | B2 | 12/2010 | Darley |

(Continued)

FOREIGN PATENT DOCUMENTS

| | | |
|---|---|---|
| EP | 2469891 | 6/2012 |
| GB | 702315 | 1/1954 |
| JP | 2011087142 A | 4/2011 |

OTHER PUBLICATIONS

PCT Int Srch PCTUS1358194, Feb. 7, 2014, James F. Kasic et al.

*Primary Examiner* — Ahmad F Matar
*Assistant Examiner* — Norman Yu
(74) *Attorney, Agent, or Firm* — Woods Patent Law

(57) ABSTRACT

Provided are bone conducting hearing devices having a normal force that secures the device to a user. A removable adhesive anchor secures an external component of the bone conducting hearing device to the user and provides reliable connecting that is comfortable, such as by a substantially uniform force generation over the contact area between the device and the user. Because the adhesive anchor is removable, a user can readily and reliably remove the device or connect the device, as desired. Also provide are methods of connecting any of the bone conducting hearing devices provided herein to a user, including the mastoid process of the user.

16 Claims, 7 Drawing Sheets

(56) References Cited

U.S. PATENT DOCUMENTS

| | | | |
|---|---|---|---|
| 8,107,661 | B1 | 1/2012 | Lynch et al. |
| 8,170,253 | B1 | 5/2012 | Lynch et al. |
| 8,255,058 | B2 | 8/2012 | Gibson et al. |
| 8,270,647 | B2 | 9/2012 | Crawford et al. |
| 8,315,705 | B2 | 11/2012 | Keuninckx |
| 8,369,959 | B2 | 2/2013 | Meskens |
| 8,452,412 | B2 | 5/2013 | Ibrahim |
| 8,515,112 | B2 | 8/2013 | Crawford et al. |
| 8,538,545 | B2 | 9/2013 | Meskens |
| 8,774,930 | B2 | 7/2014 | Ball |
| 8,787,608 | B2 | 7/2014 | Van Himbeeck et al. |
| 8,811,643 | B2 | 8/2014 | Crawford et al. |
| 8,891,795 | B2 | 11/2014 | Andersson |
| 8,897,475 | B2 | 11/2014 | Ball et al. |
| 8,897,883 | B2 | 11/2014 | Griffith |
| 8,923,968 | B2 | 12/2014 | Meskens |
| 8,934,984 | B2 | 1/2015 | Meskens et al. |
| 2007/0053536 | A1 | 3/2007 | Westerkull |
| 2007/0274551 | A1 | 11/2007 | Tsai et al. |
| 2009/0248155 | A1 | 10/2009 | Parker |
| 2009/0299437 | A1 | 12/2009 | Zimmerling |
| 2010/0145135 | A1 | 6/2010 | Ball et al. |
| 2011/0015471 | A1 | 1/2011 | Galt |
| 2011/0022120 | A1 | 1/2011 | Ball et al. |
| 2011/0216927 | A1 | 9/2011 | Ball |
| 2012/0029267 | A1 | 2/2012 | Ball |
| 2012/0041515 | A1 | 2/2012 | Meskens et al. |
| 2012/0088957 | A1 | 4/2012 | Adamson et al. |
| 2012/0238799 | A1 | 9/2012 | Ball et al. |
| 2012/0294466 | A1* | 11/2012 | Kristo et al. ..... 381/322 |
| 2012/0296155 | A1 | 11/2012 | Ball |
| 2012/0302823 | A1 | 11/2012 | Andersson et al. |
| 2013/0018218 | A1 | 1/2013 | Haller et al. |
| 2013/0046131 | A1 | 2/2013 | Ball et al. |
| 2013/0150657 | A1* | 6/2013 | Leigh et al. ..... 600/25 |
| 2013/0261377 | A1 | 10/2013 | Adamson et al. |
| 2013/0281764 | A1 | 10/2013 | Goeran et al. |
| 2014/0121447 | A1 | 5/2014 | Kasic et al. |
| 2014/0121449 | A1 | 5/2014 | Kasic et al. |
| 2014/0121450 | A1 | 5/2014 | Kasic et al. |
| 2014/0121451 | A1 | 5/2014 | Kasic et al. |
| 2014/0121452 | A1 | 5/2014 | Kasic et al. |
| 2014/0193011 | A1 | 7/2014 | Parker |
| 2014/0270293 | A1 | 9/2014 | Ruppersberg et al. |
| 2014/0275735 | A1 | 9/2014 | Ruppersberg et al. |
| 2014/0275736 | A1 | 9/2014 | Ruppersberg et al. |
| 2014/0336447 | A1 | 11/2014 | Goran et al. |
| 2015/0016649 | A1 | 1/2015 | Himbeeck et al. |

* cited by examiner

FIG. 7A
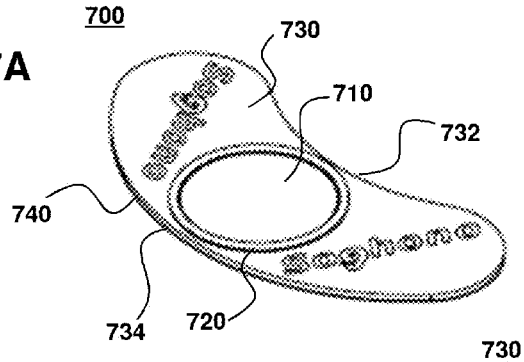
FIG. 7B
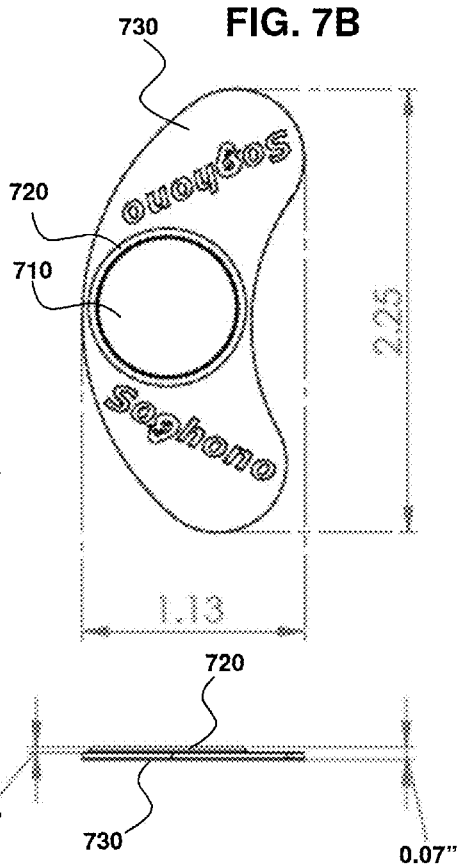
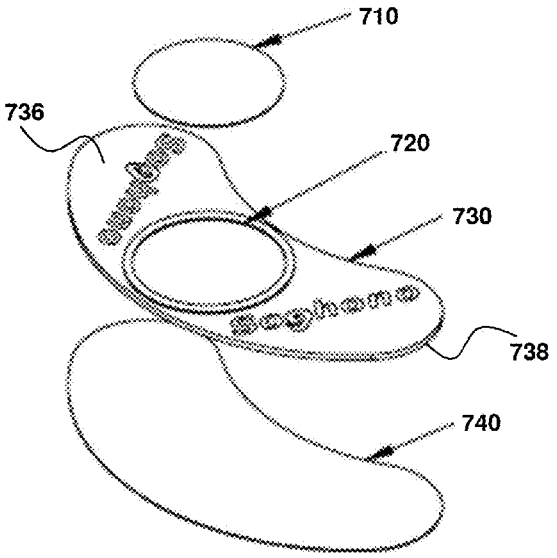
FIG. 7C

FIG. 8
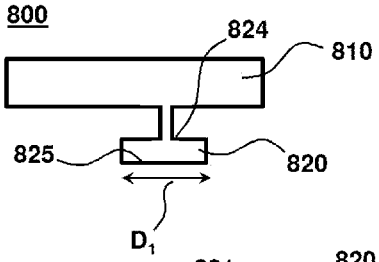
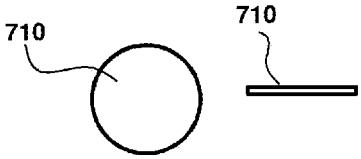
FIG. 9A
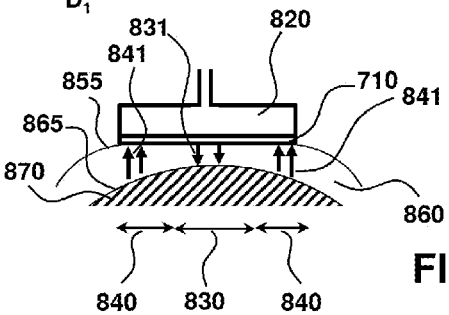
FIG. 9B
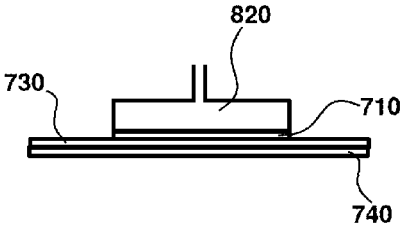
FIG. 10A
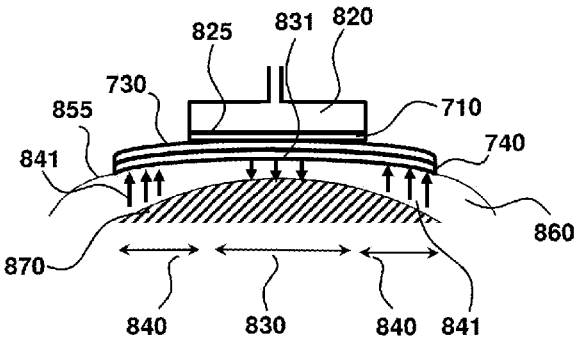
FIG. 10B

ADHESIVE BONE CONDUCTION HEARING DEVICE

CROSS-REFERENCE TO RELATED APPLICATIONS

This application claims benefit of provisional patent application 61/697,427 filed Sep. 6, 2012, which is hereby incorporated by reference to the extent it is not inconsistent with the present disclosure

BACKGROUND OF THE INVENTION

Provided herein are bone conduction hearing devices having a specially configured mechanism for securing the device to the side of the head.

Bone conduction hearing devices are a significant and important market in the field of hearing devices or hearing aids. There are five major types of bone conduction devices, including: (1) External bone conduction devices where a vibrator is held to the side of the head by a band that traverses around the head (e.g., U.S. Pat. No. 7,822,215); (2) Bone anchored hearing devices where a screw is placed through the skin into the skull and a vibrator transducer is hung to the side of the screw (see, e.g., BAHA® hearing aid by Cochlear Corp.); (3) Magnetic bone conduction hearing implants, where magnets are implanted and attached to the skull and externally positioned magnets provide a normal force to the side of the head to hold the vibrator to the head (e.g., PCT Pub. WO2010/105601); (4) Teeth vibrators where the vibrator is attached to a tooth or a dental implant (e.g., U.S. Pat. No. 7,682,303); (5) Active implantable bone conduction devices, where a transducer is implanted under the skin to vibrate the skull (e.g., SoundBridge®, Vibrant Med-El Hearing Technology; Carina®, Otologics).

For external bone conduction hearing devices, an important aspect is ensuring the external component is secured to the side of the head without adverse biological effects. For example, Raicevich et al. The Australian and New Zealand J. of Aud. 30(2):113-113 (2008) states, "long-term use of headband-worn bone vibrators has been associated with skin ulceration and, in severe cases, physical depression at the point of contact." Various studies report skin reactions around an abutment and grade them according to the Holgers classification system (Holgers et al. American J. of Otology 9(1): 56-59 (1988)) which ranges from skin irritation and erythema to an overt infection causing implant extrusion (McDermott et al. 2009; van de Bert et al. 2010; de Wolf et al. 2008; Wazen et al. 2008; Priwan and Granstrom 2005; Badran et al. 2009; de Wolf et al. 2009; Faber et al. 2009) and can include a classification score such as: 0. Reaction free; 1: Slight redness; 2: Red and moist tissue; 3: Granulation tissue; and 4: Infection requiring removal of abutment.

Examples of various systems for securing a device to the user include U.S. Pat. No. 7,822,215 (headband); U.S. Pat. No. 7,809,147 (spectacles); U.S. Pat. Pub. 2009/0290730 (ring-shape holding means); U.S. Pat. Pub. 2007/0071258 (double stick tape). The various devices disclosed in the art, however, have substantial limitations in that they either do not sufficiently and reliably provide adequate force, provide too much force, are obtrusive or uncomfortable, or require implantation with attendant costs and surgical intervention.

Provided herein, are devices that reliably and comfortably apply a normally-directed contact force to the hearing device that forces the device against the skull of the user. The devices avoid problems associated with unreliable force generation, uneven force distribution, or overly obtrusive components, thereby facilitating wearability and durability of the device, including over long periods of use.

SUMMARY OF THE INVENTION

Disclosed herein are devices and related methods that secure an external component of a bone conduction hearing device to the surface of a user.

In an aspect, provided herein is a bone conduction hearing device or hearing aid, comprising an external component and a removable adhesive anchor that secures the external component to a surface of a user. In this aspect, the removable adhesive anchor generates a normal force to secure the external component to the user. In an embodiment, the removable adhesive anchor is configured to generate a desired normal force. In a another aspect, the invention is a removable adhesive anchor for use in connecting a bone vibration hearing aid to a user, such as to the skin overlaying the mastoid region of the skull.

In an aspect, the removable adhesive anchor is selected and designed so as to generate a sufficient contact force to provide good physical contact between a vibrating portion of the hearing aid and the user's skull. In an aspect, this is accomplished by the bending mechanics of the adhesive-anchor in combination with the curvature of bone underlying the user contact surface along with adhesive strength of the adhesive layer that bonds the hearing aid device surface to the user surface. In another aspect, it is the geometry of the hearing aid external component surface that is rigid and flat in combination with underlying curvature of the user's bone. In both aspects, the interaction of the various components generates a force balance in the tissue underlying the adhesive anchor, with an outer region defined by a normal force in the direction away from the user and a central region with a counterpart normal force direction that is toward the user. The central region with the normal force direction from the hearing aid toward the user ensures good physical contact between the skull bone and hearing aid and corresponding good vibration transfer from the hearing aid to the skull bone. In an aspect, the skull bone corresponds to a mastoid process or mastoid region with an attendant curvature.

In this manner, a surface that is flat and resistant to bending is forced into a bent or deflected geometry by the interaction of an adhesive anchor that corresponds to the surface shape of a user, such as the surface shape of a mastoid region beneath the adhesive anchor. In other words, a normally flat surface is forced toward a bent geometry during use, with an attendant generated force toward flat that acts at the edges in a normal direction away from the user and toward the hearing aid device. Force statics require this force be balanced, as there is during use preferably no movement of the device or device components relative to the underlying bone. The force balance occurs in a central region, collocated underneath the hearing aid external surface, to provide intimate physical contact between the external hearing aid and the user.

This configuration is further advantageous in that the characteristics of the various components are selected to avoid pressure points on the user while maintaining sufficient contact forces. The stiffer or more resistant the adhesive anchor is to bending, the larger the contact force generated in a central region, so long as the adhesive portion that provides conformal contact between the adhesive anchor and the user, is sufficiently strong.

In an embodiment, the invention is a system for transmitting vibrations from an externally mounted hearing aid to a user's skull. In an aspect, the system comprises an external component surface and a self-adhesive anchor that reversibly secures an external component surface to a surface of the user. For bone transduction hearing aid systems, the surface of the user preferably overlays a mastoid region (also known as the mastoid process). In use, the external component surface and the self-adhesive anchor connected to the mastoid region generates a normal force distribution. The normal force distribution refers to a contact region having a force in a direction toward the user, and another region having a force in a direction away from the user. In general, the systems in use have an outer region with a force direction that is away from the mastoid region and a central region with a force direction that is toward the mastoid region. The system is configured to obtain a central region that provides sufficient contact force between the external component surface and the mastoid region to reliably transmit vibration from the external hearing aid to the mastoid region.

In one embodiment, the self-adhesive anchor comprises an adhesive layer between the surface of the user and the external component surface, and the adhesive layer is shaped for conformal contact with and to cover a portion of the mastoid region. In particular, although the mastoid region may differ in size among individuals (male; female; children), there is always a conical prominence over which the adhesive layer is placed. The mastoid then curves downward from the conical prominence as a function of the distance from the central conical prominence. This geometry is utilized by the devices and methods provided herein to generate good contact force in a reliable and cost-effective manner while maintaining high user comfort.

In an aspect, the external component surface is a contact pad having a flat surface for connection to the self-adhesive anchor, and an opposable positioned surface vibrationally connected to a vibrator of the hearing aid device. For example, a cylindrically-shaped metallic pad may be connected to the hearing aid device at one face of the cylinder, with the opposed face of the cylinder corresponding to the external component surface in the shape of a flat surface. The precise shape of the flat surface is not critical, so long as there is sufficiently large surface area to ensure coverage of the mastoid region having sufficient curvature or displacement. In an aspect, the flat surface shape is substantially circular or circular, so as to provide easier alignment, compared to a multi-sided shape. "Substantially circular" refers to no dimension of the contact surface that deviates by more than 10% of an average diameter, with the average diameter, D, calculated as:

$$D = \sqrt{\frac{4}{\pi}A}$$

wherein A is the surface area of the surface. In an aspect, the flat surface shape is circular, having a diameter selected from a range that is greater than or equal to 5 mm and less than or equal to 25 mm, and more preferably is greater than or equal to 10 mm and less than or equal to 20 mm.

In an aspect, the surface shape has an average diameter selected from a range that is greater than or equal to 1 cm and less than or equal to 2 cm, or, alternatively, a surface area that is greater than or equal to 0.7 $cm^2$ and less than or equal to 3.5 $cm^2$. The surface area may be selected based on the size of the user (e.g., the mastoid shape and curvature), the size, weight and shape of the bone conduction hearing aid, and the hearing loss characteristics to be addressed by the hearing aid.

In an embodiment, the self-adhesive anchor comprises an adhesive layer having a surface shape and surface area that corresponds to a surface shape and surface area of the contact pad flat surface, such as a circular shape. In this aspect, "corresponds" refers to an absolute deviation in any parameter that is no more than 10%, no more than 5%, no more than 1%, or that is within 1%, such as, a diameter or surface area that is within a selected percentage of each other.

In an aspect, the self-adhesive anchor comprises a retainer pad having a top surface and a bottom surface, a top adhesive layer for connecting the retainer pad top surface to the external component surface, and a bottom adhesive layer for connected the retainer pad bottom surface to the mastoid region.

In an embodiment, the retainer pad is shaped for placement behind the ear in a visually unobtrusive manner. In this embodiment, the retainer pad shape has a concave edge for positioning closest to an ear and a convex edge opposed to the concave edge for positioning furthest from an ear. In this manner, the retainer pad curves around behind the ear during use.

The top adhesive layer has a top adhesive layer surface shape, the retainer pad further comprising a boss feature having a boss feature shape corresponding to the top adhesive layer surface shape for receiving the top adhesive layer. "Boss feature" refers to a raised element or relief feature on the surface for placing and containing the adhesive layer. Accordingly, the boss feature defines a receiving volume on the top surface of the retainer pad. For a top adhesive layer that is circular, for example, the boss feature may be ring-shaped. For a top adhesive layer that is ellipsoid or rectangular, the boss feature may be correspondingly ellipsoid or rectangular. The height of the boss feature may correspond to at least the top layer adhesive thickness, including with any liner or without any liner. In an aspect the height of the boss feature is within about 10% the thickness of the adhesive layer to be contained by the boss feature. In an aspect, the boss feature is sufficiently high to also receive and contain the hearing aid external component surface. In an aspect, the boss feature has a height that is about 0.03", or that is selected from a range that is greater than or equal to 0.5 mm and less than or equal to 1.5 mm. In an aspect, the boss height is selected to facilitate precise placement of both the top adhesive layer and the external component surface. In an aspect, the top adhesive layer is applied first to the external component surface, and the combination placed within the receiving volume. Alternatively, the top adhesive layer is positioned in the receiving volume first, followed by intimate contact with the external component surface. In both situations, the boss feature assists with precise placement of the external component surface, and therefore, location relative to the mastoid region of the user. Appropriate positioning is important to ensure the normally directed contact force is collocated underneath the external component surface, thereby ensuring good contact between the hearing aid vibrator and the skull.

Any of the systems provided herein, may have a retainer pad and bottom adhesive layer each with a surface shape that corresponds to the other.

The systems provided herein may be further described in terms of surface areas. For example, the retainer pad has a surface area and the external component surface has a surface area, wherein a surface area ratio of the retainer pad to external component surface is selected from a range that is greater than or equal to 1 and less than or equal 5, or any sub-ranges thereof.

In an embodiment, the self-adhesive anchor has a physical property selected from one or more of a thickness selected from a range that is less than or equal to 5 mm and greater than or equal to 0.1 mm, or between about 10 mils and 1000 mils; a net bending stiffness to provide an outer end deflection value selected from a range of 0.08" to 0.25" under an applied load of about 0.8 lbf to 2.5 lbf to the outer end. In an aspect, the adhesive strength is selected to be sufficiently strong to maintain the deflection without delamination from any of the respective surfaces. In an aspect, the system is configured to provide a net bending force or an effective spring constant that is selected from a range that is greater than or equal to 0.1 N and less than or equal to about 5 N.

In an aspect, the applied load is generated by the bottom adhesive layer connected to a curved surface that correspondingly curves the retainer pad. For example, the applied load may be selected from a range that is greater than or equal to 1 lbf (about 4.4 N) and less than or equal to 2 lbf (8.8 N). In an aspect, any adhesive anchor that falls within this parameter range may be used to anchor a hearing aid to a user.

In an embodiment, the adhesive layer is two-sided removable medical adhesive. Examples of such adhesive includes double coated polyethylene medical-grade tape, including optically transparent tape, such as MED 3044 (Avery Dennison Corporation—Vancive) or by 3M. In an aspect, the thickness of the adhesive anchor layer in use is selected from a range that is greater than or equal to 0.1 mm and less than or equal to 1 mm, or that about 0.2 mm to 0.4 mm In another embodiment, the invention is a self-adhesive hearing aid pad for connecting a hearing aid to a user surface. In an aspect, the hearing aid pad comprises, in combination, a conformable retainer pad having a top surface and a bottom surface, a top adhesive layer for connecting to the retainer pad top surface for connecting the retainer pad to an external component surface of the hearing aid, and a bottom adhesive layer for connecting to the retainer pad bottom surface for connecting the retainer pad to the user surface. Optionally, a boss feature on the retainer pad top surface receives and positions the top adhesive layer on the retainer pad top surface. During use, the retainer pad conforms to a curvature of the user surface by deflection of an outer portion relative to an inner portion, to generate an upward directed force along an outer edge of the retainer pad and a downward directed force within an inner region to provide good contact between the conformable retainer pad and the user surface. In the aspect where the self-adhesive hearing aid pad is positioned over the mastoid region, the central region is positioned over the conical prominence and at that point the retainer pad does not deflect. As the mastoid surface curves, however, the overlaying skin surface and, correspondingly the retainer pad, deflects and curves during use. That deflection is reflected in a generated contact force in a central region of the retainer pad.

In an aspect, the top adhesive layer is connected to an external component surface of a hearing aid. In an aspect, the self-adhesive hearing aid pad has a surface area selected from a range of 1 $cm^2$ and 15 $cm^2$, and the surface area is available for physical contact with skin overlying a mastoid region.

In an aspect, the central region for any of the systems described herein is defined as the inner-most 10%, 20%, or 50% of the surface area. In an aspect, the outer region for any of the systems described herein is defined as the outer-most 20%, 50% or 70% of the surface area. In an aspect, the central region corresponds to the external component surface position relative to the user surface. In an aspect, the locations of the inner and outer regions are empirically determined, such as to contain at least about 70%-100%, or any range therein, of the corresponding inwardly-directed and outwardly-directed normal forces.

The invention also provides various methods related to the devices described herein. In an aspect, provided is a method of securing a bone conducting hearing device to skin overlaying a mastoid region of a user, including by any of the self-adhesive anchors described herein. In an embodiment, the method comprises positioning an adhesive anchor on skin overlaying the mastoid region of the user and connecting a bone conducting hearing device to the adhesive anchor to generate an outer directed force in skin positioned beneath an outer portion of the adhesive anchor. The outer directed force is generated because the resting state of either the adhesive anchor and/or the a contact surface of the bone conducting hearing device tends to be flat and, at the outer edges, the mastoid bone surface and skin contact surface is curved away from the hearing aid device. Accordingly, the outer region force is away from the user. Force statics accordingly requires a counterbalancing of the outer directed force with an inward directed force in skin positioned beneath an inner portion of the adhesive anchor. The inward directed force reliably secures the bone conducting hearing device to the user.

In an embodiment, the method further comprises the step of deforming the adhesive anchor, such as a retainer pad, to conform to the shape of the mastoid beneath the adhesive anchor, thereby generating the outer directed force. In an aspect, the resting state of the adhesive anchor and retainer pad is flat to generate the outer directed force, when the adhesive anchor and retainer pad conforms to the user's curved surface shape. In an aspect where only adhesive tape is used, the stiff flat geometry of the hearing aid external component surface in combination with the curvature and adhesive, generates the outer directed force.

In an embodiment, any of the methods and devices relate to disposable self-adhesive anchors that are readily mounted to, and removed from, skin. This is particularly advantageous in that the need for bone anchored abutments is avoided, without sacrificing reliable physical contact. Accordingly, hearing aid devices are removed and connected in a straight-forward and easy manner. The systems may be designed to provide use over the range of a day or so and then, for example, before sleep the self-adhesive anchor removed from the skin and the hearing aid, with the hearing aid and a new self-adhesive anchor ready for use the next day. Alternatively, the self-adhesive anchor, such as a retainer pad portion, may be configured for repeated use. As needed, the adhesive layers may be replaced so as to ensure sufficient bond strength is maintained. In an aspect, the adhesive layers are delaminated from the user surface and/or the hearing aid external component surface without leaving noticeable or observable residue on the user surface and/or external component surface.

In an aspect, the normal force can be varied over a range of forces as desired, such as depending on operating conditions and/or device geometry. In general, devices that are larger or heavier require a larger normal force to secure the device to the user than a corresponding device that is smaller or of lower weight. In an aspect, the normal force applied to any of the devices or in any of the methods is selected from a range that is greater than or equal to 0.25 N and less than or equal to 10 N. In an aspect, the force is substantially uniform over the contact surface defined by the area of contact between the external component and the underlying user surface, thereby avoiding or minimizing unwanted pressure points. "Substantially uniform" refers to a force over a defined area (e.g., a pressure) that differs by less than 20%, less than 10% or less than 5% of a desired force or pressure, such as the average force or pressure over the entire contact surface area. Alternatively, the distribution of forces may be defined functionally in terms of being sufficiently distributed to avoid irritation to the user, such as skin irritation associated when force on a particular region is too high and, in severe cases local tissue ischemia and associated tissue ulcers or tissue necrosis.

Such a functional description may be based on the Holgers classification system, quantified as ranging from 0 (no visible effects), 1 slight redness and slight swelling, 2 red and moist tissue with moderate swelling, 3 granulation, infection resulting in removal of the implant. In an aspect, the device provided herein results in a score under such a system that is 0 or 1, on average.

In an embodiment, the normal force is selected so as to provide a contact-pressure between the bone conduction hearing device and the underlying tissue that is less than about 3.7 kPa.

In an aspect, the normal force is applied over a contact surface area, such as a contact surface area that sufficiently spreads the force over the user surface to avoid a pressure point, such as a surface area that is greater than or equal to 1 $cm^2$ and less than or equal to 5 $cm^2$.

Provided herein are a number of adhesive anchor embodiments. In one embodiment the adhesive anchor comprises a cantilever having a first end and a second end and an adhesive component connected to a user. The cantilever first end is connected to the adhesive component and the cantilever second end is connected to the external component. In this configuration, the cantilever generates the normal force. The cantilever can be connected to an externally-facing surface of the external component, with the normal force then exerted on the externally-facing surface and directed toward the skin overlying the skull, such as in a direction that is normal to the skin and skull surface (e.g., "normal force"). Alternatively, the second end of the cantilever can be connected to other surfaces of the external component, including in addition to the externally-facing surface. For example, the cantilever second end can be shaped to fit around the external component so that the normal force corresponds to force exerted around the outer edge surfaces of the external component. In an aspect, the cantilever second end connects to both the externally-facing surface and around one or more of the outer edge surfaces of the external component, such as in a cup-like configuration. In this manner, there is increased contact area between the cantilever and the external component, thereby better securing the external component and additionally controlling the force distribution from the cantilever onto the external component, and thereby onto the user surface.

In another embodiment, the adhesive anchor comprises an adhesive that secures the external component to the user. In an aspect, the adhesive is adhesive tape having a first end and a second end, with the first end secured to the user at a first position and the second end secured to the user at a second position. The first and second positions are separated by a separation distance. The adhesive tape has a central portion between the first and second ends secured to an outer surface of the external component. To facilitate a desired force or pressure distribution on the skin surface over the skill where the device is positioned, the external component further comprises a spring element that connects a transducer and an external housing assembly. The transducer portion can include a vibrator and is preferably positioned against the surface of the user. The external housing assembly has a first surface connected to the spring element and a second surface connected to the adhesive tape. The external housing assembly first and second surfaces are opposed to each other and the adhesive tape central portion exerts the normal force on the external housing assembly second surface to secure the transducer to the user, including via the spring element. In an aspect, the housing assembly and the transducer form a single unitary device, having an internal volume in which the one or more spring element(s) facilitate force transmission from the external housing portion to the transducer, and on to the user surface.

In an aspect, the separation distance between the first and second positions of the user to which the adhesive elements or adhesive tape is secured is selected to reliably secure the device to the user, including so as to generate the desired normal force. In an aspect, the separation distance is greater than or equal to 1 cm and less than or equal to 6 cm.

In an aspect, the adhesive tape is shaped, such as substantially circular shaped. In this aspect, the first and second ends of the adhesive tape form part of an outer perimeter of adhesive that generates an outer perimeter adhesive contact area with the user, and the central portion is confined within a region formed by the outer perimeter of adhesive to secure the external component to the adhesive tape.

In an embodiment, the adhesive component is an adhesive such as a contact adhesive, pressure-sensitive adhesive, or a temperature-dependent adhesive. In an aspect, the adhesive is removable, in that in can be removed as desired from the user surface without leaving substantial residual remnants, in contrast to a permanent adhesive where removal tends to leave a substantial residual component. Removable adhesives form a temporary bond with the user surface and/or the device, and can be removed as desired, such as daily or more than daily. In an aspect, the removable adhesive may be repeatedly used. In an aspect, the removable adhesive may be removed and discarded, with a new removable adhesive used each time. In an aspect, the removable adhesive is a tape, such as a single-sided or a double-sided tape.

In an embodiment, the spring element is configured to provide an optimum normal force between the transducer and a skull that is substantially uniformly distributed over a contact surface of the transducer in contact with the user. This embodiment is of importance to ensure the device is comfortable to wear. Functionally, a substantially non-uniform force distribution over the contact surface between the device and user is reflected in terms discomfort expressed by the user, and attendant reddening of the skin in regions described as an unwanted or undesirable "pressure point". If not addressed, such pressure points can lead to tissue abrasion and in severe cases tissue necrosis. It is important to avoid undesirable pressure points by reducing the force in that region, including by reducing the normal force or by further shaping the portion of the device that contacts the user surface. In an aspect, the spring element is positioned so as to provide uniform force distribution. In an aspect, the uniform force distribution is achieved by providing a plurality of spring elements Accordingly, in an aspect any of the devices and methods provided herein further relate to shaping the hearing device surface that contacts the user skin to avoid pressure points that generate discomfort or pressure-induced reddening of the user skin, such as by substantially uniformly distributing the normal force across the user skin contact surface area. In an aspect, the transducer contact surface has a surface area selected from a range of 1 $cm^2$ and 10 $cm^2$, and the surface area is in physical contact with skin overlying skull.

One of the advantages of the instant technology is the ability to generate a suitable normal force without the need for undesirable components that can be uncomfortable, obtrusive, or overly intrusive. Accordingly, one embodiment of the invention is any of the bone conduction hearing devices or method of exerting a normal force that is abutment-free, headband-free or both. Headband-free is used broadly to refer to and component that spans a significant circumference of the user skull that secures the device to the head, and can include spectacles, head-sets and soft-bands.

In an embodiment, any of the hearing devices provided herein, and methods related thereto, relate to the external component portion that contacts the user that is configured and shaped to fit against skin overlying the skull of the user, including configured to ensure unwanted pressure points are avoided. In an aspect, the inner surface of the external component is in conformal contact with the skin overlying the skull of the user. In this embodiment, the shaping helps contour the external component inner-facing surface to the shape of the skull, thereby providing conformal contact between the inner-facing surface and the underlying user surface.

In an aspect, any of the hearing devices provided herein further comprise one or more internal magnets for generating a portion of the normal force, wherein the magnets are positioned under the user surface and in magnetic connection with the external component.

In an embodiment, one or more external magnets are positioned external to the user surface and connected to the external component, wherein the external magnets are in magnetic connection with the internal magnets.

In another embodiment, provided herein is a method for securing a bone conducting hearing device to skin overlaying a mastoid region of a user, including for any of the devices disclosed herein. In an aspect, the method is by connecting one end of an adhesive anchor to the skin in a region adjacent to the mastoid. A second end of an adhesive anchor is connected to the bone conducting hearing device. A force is applied onto the bone conducting hearing device in a normal direction by the adhesive anchor, wherein the applied force exerted against the user is substantially uniform over a surface contact area between the bone conducting hearing device and the user. The adhesive anchor may be any of the adhesive anchors provided herein. In an aspect, the surface contact area is greater than or equal to 1 $cm^2$ and less than or equal to 10 $cm^2$, or any sub-ranges thereof, such as between about 2 $cm^2$ and 7 $cm^2$. In an aspect, the substantially uniform force distribution over the surface contact area is achieved, at least in part, by shaping the contact surface of the external component (e.g., the inner surface) to provide conformal contact between the external component contact surface and the skull underlying the contact surface.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 7A illustrates a self-adhesive hearing aid pad. FIG. 7B is a top view (top panel) and a side view (bottom panel). FIG. 7C is a blow apart assembly illustrating the different components of the self-adhesive hearing aid pad.

FIG. 8 is a hearing aid device comprising a pad attached to a vibrator suitable for use with the system illustrated in FIG. 7A-7C.

FIG. 9A is a top view (left panel) and side view (right panel) of an adhesive pad suitable for use with children. FIG. 9B is the adhesive pad used with the pad of the hearing aid of FIG. 8 when adhered to the user. Due to the curvature of the underlying bone and the flat surface of the pad, a force distribution arises with a central region having a normal force directed toward a user and an outer region having a normal force directed toward the device.

FIG. 10A is a side view of the adhesive hearing aid pad of FIG. 7 and hearing aid pad of FIG. 8 for use by an adult. FIG. 10B is the adhesive pad used with the pad of the hearing aid of FIG. 8 when adhered to a user, illustrating curvature of the bone curves the adhesive hearing pad, resulting in similar force distribution as summarized in FIG. 9B.

DETAILED DESCRIPTION OF THE INVENTION

Figure 1:
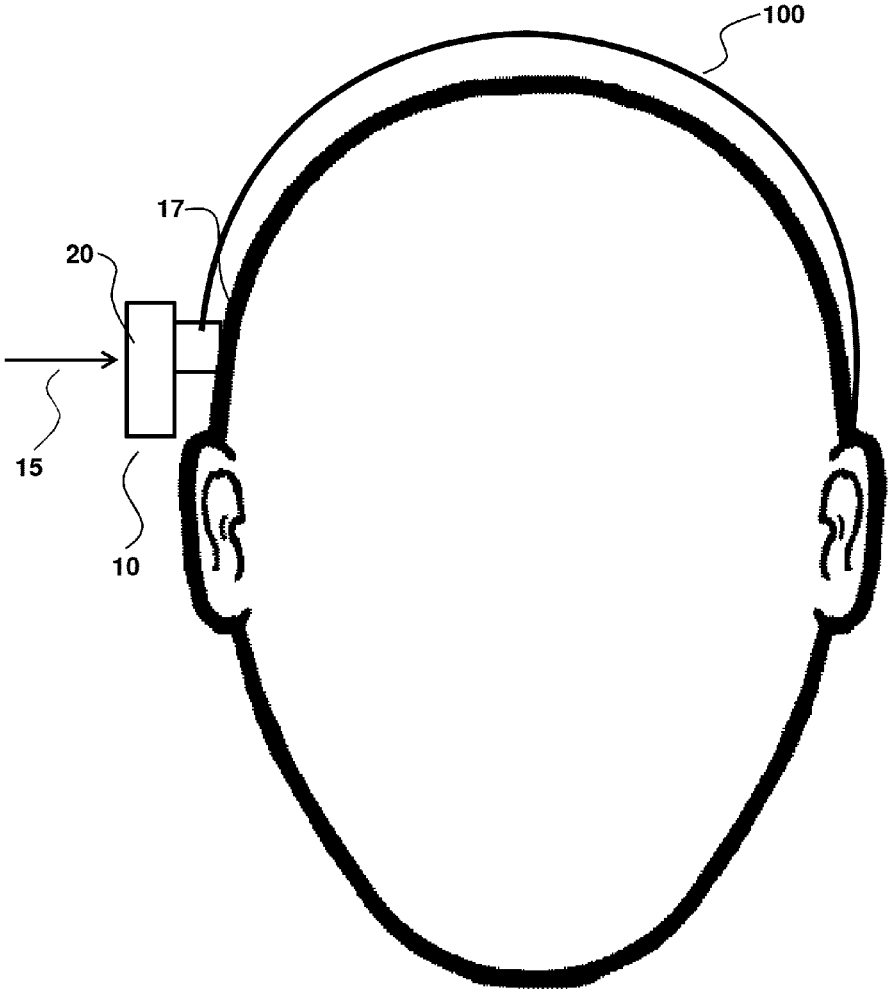
FIG. 1 illustrates a head-band configuration for securing a hearing device against the skull.

As used herein, "external component" of a bone conduction hearing device refers to that portion of the device that is positioned externally with respect to the skin of the user. Typical portions of the external component includes a transducer that detects sound and transforms the detected sound into vibrations by a vibrator unit. Those vibrations are transmitted to the skull, with the skull vibrations detected by at least the downstream portion of the user's auditory system, thereby facilitating hearing by the user. An internal component, in contrast, refers to any portion of a device that is implanted into a user, such as under the skin. In an aspect, any of the devices and methods provided herein relates to a device that does not have any internal components. An "external component surface" refers to a surface of the hearing aid configured to connect to the user surface, such as via an adhesive anchor. The external component surface may be flat and relatively rigid, such as formed from a metallic disk that is physically connected to the vibrator of the hearing aid. The external component surface may be a magnet or made of a magnetizable material for magnetically connecting with a magnet or a magnetizable material.

An "adhesive anchor" refers to the portion of the device that secures the external component to a surface of a user, such as a surface that is the skin overlaying the skull. In an aspect, the portion of the skull is part of the temporal bone, including the mastoid portion of the temporal bone in the region above and around the ear. An adhesive anchor that is "removable" refers to a configuration of the external component and adhesive anchor that facilitates repeated removal and securing of the external component from and to the user surface. Alternatively, the system may be configured as a disposable system, where low cost portions are after use disposed and replaced with new portions for subsequent use.

Removable, in certain aspects, refers to a component that may be removed from a surface by a user, without the need for any special tools or procedures, such as by delaminating or peeling the component off the surface without leaving substantial material behind. Any material remaining is generally residual adhesive, and may be easily rubbed or washed off, without irritating a surface, such as a surface that is skin. In an aspect, the removable component is reused. In an aspect, the removable component is disposable, in that once removed the removable component may be discarded and a new removable component used. In an aspect, the removable component is the self-adhesive anchor. In an aspect, the removable component is a part of a self-adhesive anchor that comprises a plurality of assembled components. For example, an adhesive layer may be disposable, with the retainer pad to which the adhesive layer connects reused.

"Normal force" refers to a force applied in a direction that is normal to the surface upon which the external component is secured. The normal force may be outwardly or inwardly directed, relative to the user. The normal force may also be described in terms of a force distribution, pressure distribution or average pressure over the user surface in physical contact with the hearing device, including the external component. An average pressure is calculated as the normal force divided by the contact surface area over which the force is applied. In an aspect, the force is applied such that the force or pressure is substantially uniform over the contact surface area, thereby avoiding undesirable pressure points. In an aspect, the normal force and contact surface area are selected so as to ensure the resultant pressure is sufficiently low that capillary closure in the capillaries underlying the bone conduction hearing device is avoided. In an aspect, the pressure is less than about 3.7 kPa over an extended period of time, measured in hours.

"Conformal contact" with a user surface refers to a component that covers a user surface and whose contact surface shape is governed by the shape or contour of the user surface. Functionally, conformal contact ensures that unwanted pressure points are avoided by evenly distributing the force exerted over the contact surface area. In contrast, a device without conformal contact suffers from the disadvantage that any non-uniformities in the user surface shape will tend to experience higher localized force exertion and, therefore, an unwanted pressure point.

"Bending stiffness" is a mechanical property of a material, device or layer describing the resistance of the material, device or layer to an applied bending moment. Generally, bending stiffness is defined as the product of the modulus and area moment of inertia of the material, device or layer. A material having an inhomogeneous bending stiffness may optionally be described in terms of a "bulk" or "average" bending stiffness for the entire layer of material. An important aspect of the instant invention is appropriate selection of bending stiffness in combination with adhesion strength of an adhesive or bonding layer. If the bending stiffness is too high and the adhesion strength too low, a material will not conform to the mastoid region, but instead will bend back away from the curved user surface to flat a geometry, pulling away from the adhesive layer or pulling the adhesive layer away from the skin. If the bending stiffness is too low, the normal force in the layer central portion corresponding to the contact force will be correspondingly too low with physical contact between the hearing aid and skull also too low for reliable and high fidelity vibration transfer. Accordingly, provided herein are specific components having physical properties selected to achieve comfortable and reliable contact forces for releasably connecting a hearing aid device to the mastoid region for vibration transfer and, accordingly, hearing assistance. One example of a suitable bending stiffness is an applied bending moment force of about 1.65 lbf, including ranging from about 1 lbf to about 2 lbf, to generate a displacement or deflection from flat of about 0.165", including ranging from about 0.08" to about 0.25", such as at the outer ends.

The invention may be further understood by the following non-limiting examples. All references cited herein are hereby incorporated by reference to the extent not inconsistent with the disclosure herewith. Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

Example 1

Headbands

Figure 2:
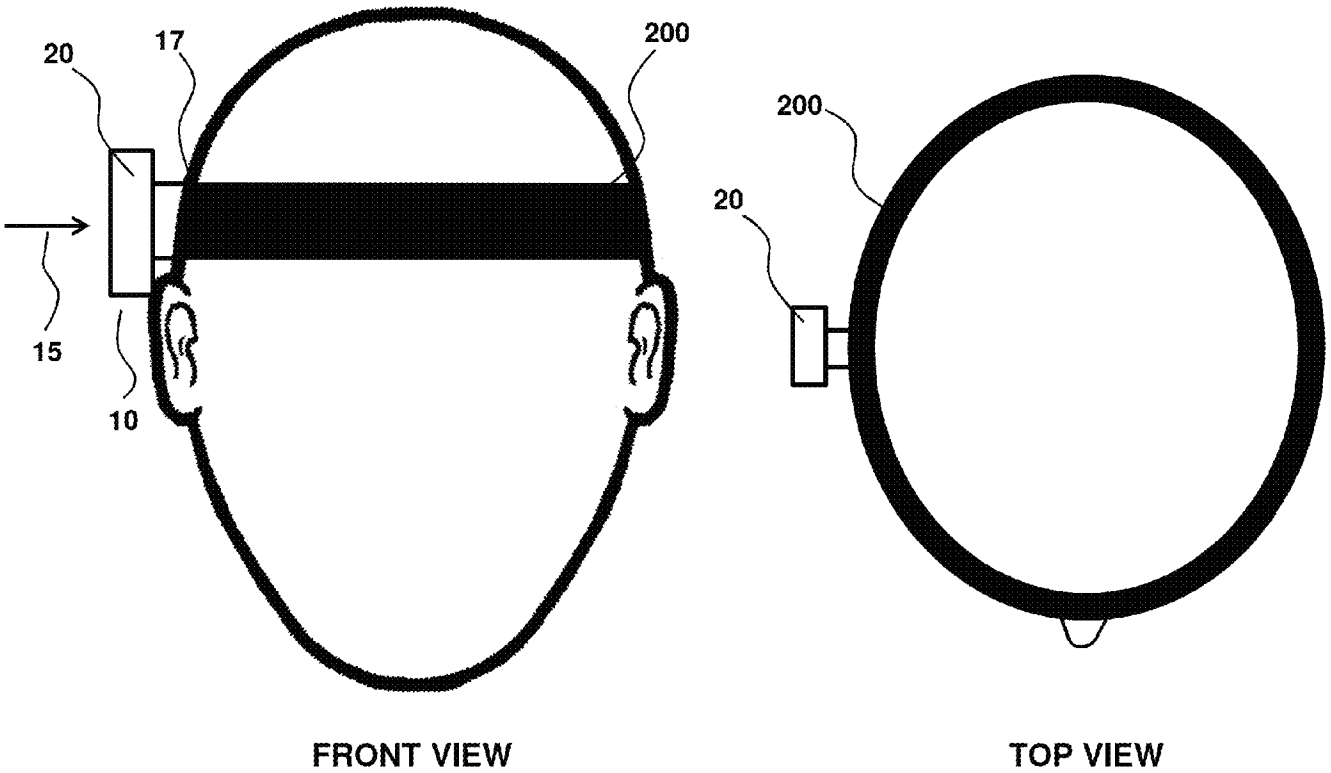
FIG. 2 illustrates a soft-band configuration for securing a hearing device against the skull.

FIGS. 1-2 illustrate an embodiment where a headband 100 (FIG. 1) or a softband 200 (FIG. 2) provide a normal force 15 that secures an external component 20 of a hearing device 10 to a user surface 17. This example suffers a number of disadvantages, such as the band 100 or 200 being uncomfortable, unsightly and unreliable during use, particularly as to providing a well-defined and controlled normal force. Accordingly, an aspect of the invention relates to an adhesive anchor that is not a headband, softband or any other band that transits around the head.

Example 2

Magnets

Figure 3:
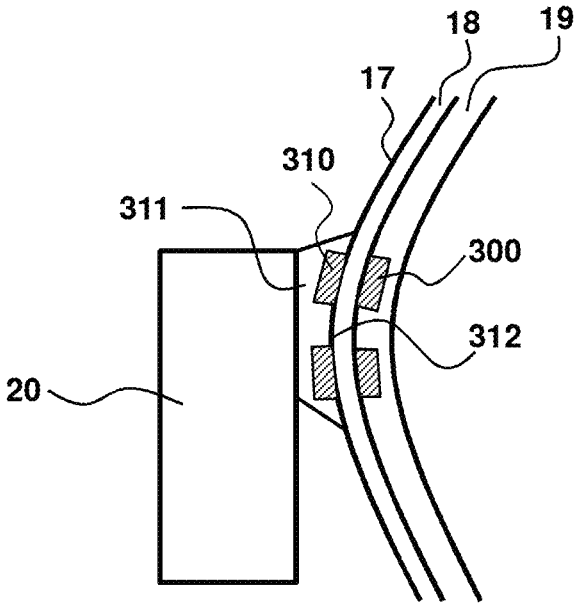
FIG. 3 illustrates a magnetic configuration for securing a hearing device against the skull.

FIG. 3 illustrates an embodiment where magnets provide a normal force to secure an external component 20 to a user surface 17. In this embodiment, the magnets include internal magnets 300 and external magnets 310 secured within magnet spacer 311, relative to user surface 17 that corresponds to skin 18 overlying the skull 19. In this aspect, the magnets 300 and 310 may be considered to form an adhesive anchor that is partially removable in that upon removal of the external component the internal magnets 300 remain implanted in the user. In an aspect, the magnet spacer 311 has an inner surface 312 shaped for conformal contact with the skin 18 overlying the skull 19.

Example 3

Adhesives

Figure 4:
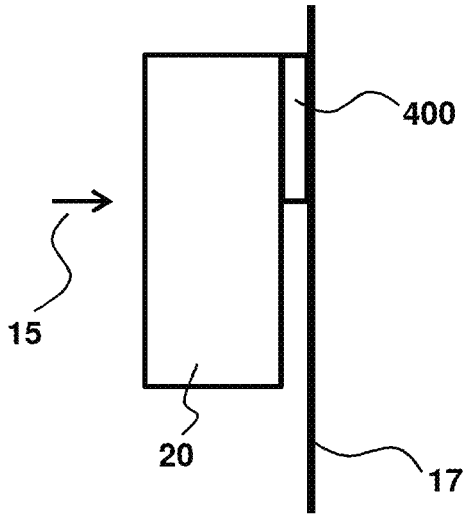
FIG. 4 illustrates an adhesive for securing a hearing device against the skull.

FIG. 4 describes the simplest form of an adhesive anchor 400 that secures the external component 20 to the user surface 17. In an embodiment, the adhesive anchor is an adhesive material having a first and a second surface that is sticky, so that the first end sticks to the user surface 17 and the second surface to the external component 20. A drawback with this embodiment is that the generated normal force 15 is often too low to provide good vibration transmission. This is indicated by the short length of the normal force arrow 15.

FIGS. 7-10 illustrate an embodiment where a self-adhesive anchor, such as an adhesive layer, generates a sufficient normal force to transmit vibration to the skull while maintaining reliability and comfort, including over use on the time frame of a day or more. FIG. 7 illustrates an adhesive anchor 700 that may be used, for example, in an adult. FIG. 7A is a perspective view of a fully assembled self-adhesive anchor 700 with a top adhesive layer 710, a boss feature 720, a retainer pad 730, and a bottom adhesive layer 740. The adhesive anchor may be shaped for placement behind the ear by providing concave edge 732 and convex edge 734. FIG. 7B is a top view (top panel) and side view (bottom panel), illustrating exemplary dimensions (in inches). FIG. 7C is an equivalent view of FIG. 7A, with the individual components separated, also illustrating relative positions of retainer pad top surface 736 and bottom surface 738.

Figure 11:
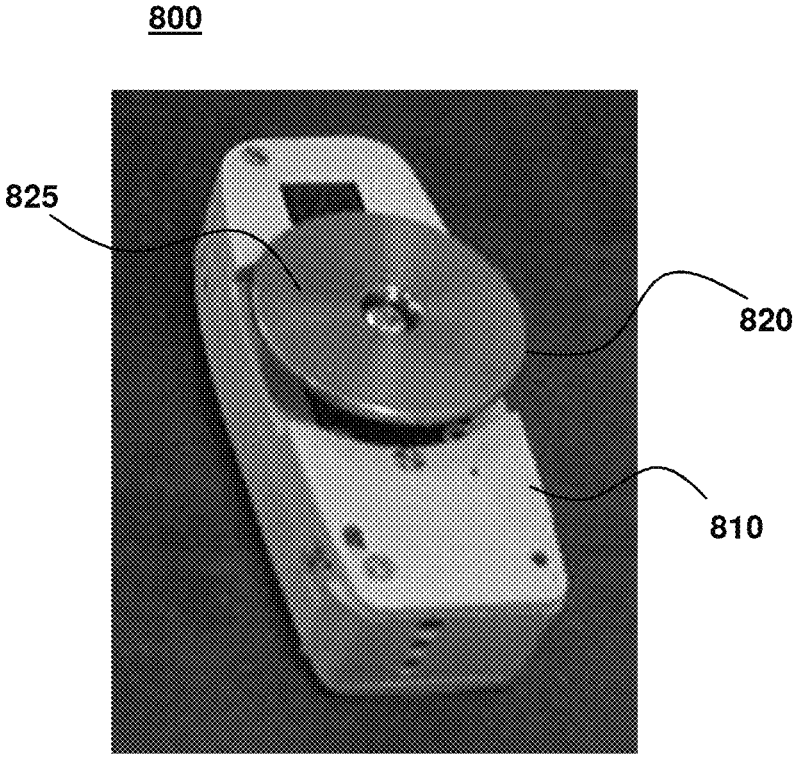
FIG. 11 shows the hearing aid device with an external component surface operably connected thereto.

FIG. 8 is a side view of an externally mounted hearing aid 800 with an external portion, such as a vibrator 810 that transforms and amplifies sound waves into vibrations. Hearing aid pad 820 with an external component surface 825 of contact dimension $D_1$. In an aspect, the dimension of the external component surface, $D_1$, is between about 1 cm and 2 cm. External component surface 825 of pad 820 connects to a self-adhesive anchor which, in turn, connects to a user surface, as illustrated in FIGS. 9-10. The other side 824 of the pad 820 vibrationally connects to the hearing aid vibrator portion 810. An example of a bone vibrating hearing aid 800 comprising a vibrator portion 810 connected to a hearing aid pad 820 having an external surface 825 is provided in FIG. 11.

Referring to FIG. 9, an adhesive anchor suitable for use in children or others having a relatively small size mastoid process or region is in the form of a circular-shape adhesive layer 710. FIG. 9A shows a top view (left panel) and a side view (right panel) of a self-adhesive anchor 710 that corresponds to an adhesive layer, in this example, double-sided adhesive tape. FIG. 9B shows self-adhesive anchor 710 in use with hearing aid pad 820 to connect hearing aid to user surface 855 corresponding to skin tissue 860 overlaying the mastoid region, indicated by bone 870 having a surface curvature 865. In this example, the interaction between hearing aid pad 820, having a flat contact surface that is the external component surface 825, with the self-adhesive anchor 710 overlying bone 870 having a curved surface 865, generates a force distribution 831 841. The force distribution is reflected in the direction of force arrows 831 and 841 through the tissue 860 over the inner region 830 and outer region 840, respectively.

FIG. 10 illustrates a system for use with an adult (see also FIG. 7), typically having a larger mastoid bone region than for children. A retainer pad 730 is incorporated in the self-adhesive anchor. The retainer pad 730, under resting conditions is flat (FIG. 10A). A bottom adhesive layer 740 is in conformal contact with and bonded to the user surface 855, over the mastoid bone 870 and bone surface 865. The adhesive layer conforms to the curvature of the user surface 865. Accordingly, during use (see FIG. 10B), the hearing aid pad 820 is connected to the retainer pad 730 such as via a top adhesive layer 710. Optionally, top adhesive layer 710 corresponds to an adhesive anchor 710 illustrated in FIG. 9A. Optionally, top adhesive layer does not correspond to the adhesive anchor used for children, such as having a different size, shape and/or composition tailored for the adult application and specifically, to fit and/or match external component surface 825. Referring to FIG. 10B, the retainer pad 730 and bottom adhesive layer 740 are selected to have an appropriate bending stiffness and bond strength, respectively, such that the retainer pad 730 outer edges deflect down and curve the retainer pad 730 from a flat state to a curved state (compare 730 in FIG. 10A to FIG. 10B) under an applied bending force generated by the bottom adhesive layer. The deflected outer edges generate a normally-directed force 841 in the direction toward the hearing aid device in the surface tissue 860, as the resting state of the deflected edges are located toward the hearing aid. Due to adhesive bottom layer 740 having an adhesive bond strength sufficiently high to prevent delamination with any of the surfaces 855 and 825, the normally-directed force 841 generated by retainer pad 730 ends are transmitted to the tissue 860 in an outer region 840. Force balance, accordingly, requires an equal and opposite normal force 831 in a central region 830 of the tissue. This central region 830 force is confined, for example, to an area corresponding to the hearing aid pad, and therefore provides excellent contact force between an externally vibrating hearing aid and the user bone 870.

A similar principle occurs in FIG. 9B, except the hearing aid pad has a high bending stiffness, and does not deform during use, and pulls up the outer edges of the tissue 860.

Alternatively, the adhesive layer may connect to a magnet, which in turn connects to the external component surface 825. Such a magnet can be useful in assisting with the positioning and mounting of hearing aid 800 to a user surface by minimizing concern of appropriate alignment between the adhesive and the external component surface.

Finite Element Analysis (FEA): FEA is used to determine the force required to deflect the plastic ear pad to match the curvature of the bone that underlies the plastic ear pad during use of the hearing aid device. This analysis is relevant in selecting the appropriate adhesive for use with a particular plastic ear pad composition and configuration. In particular, deflection or bending of the plastic ear pad during use is helpful in generating an appropriate force distribution during use. Typical deflection ranges corresponding to the curvature of the mastoid region is about 0.165 inches. The material property of the self-adhesion anchor of FIG. 7 is modeled as unfilled injection molded polycarbonate. Loads are applied until the 0.165 inches deflection is achieved.

FEA Experiments

Results of the in silico FEA experiments indicate that a 1.65 lb force applied to the outer extremities of the self-adhesive anchor provides the required deflection. Stress at that deflection is calculated as about 3000 psi. In certain aspects, the material properties of the self-adhesive anchor is selected so as to avoid plastic creep, which will functionally result in a decrease the contact force over time. Alternatively or in addition, the anchor is disposable, so that the anchor is discarded before substantial plastic creep occurs.

Example 4

Springs

Figure 5:
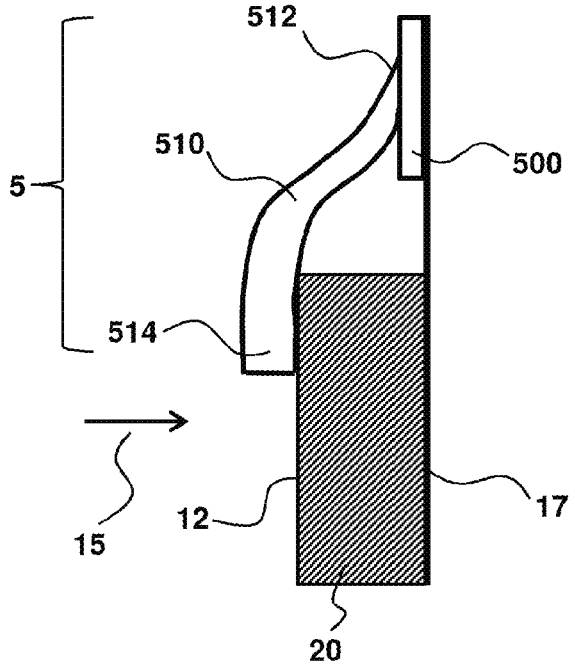
FIG. 5 illustrates an adhesive and spring for securing a hearing device against the skull.
Figure 6:
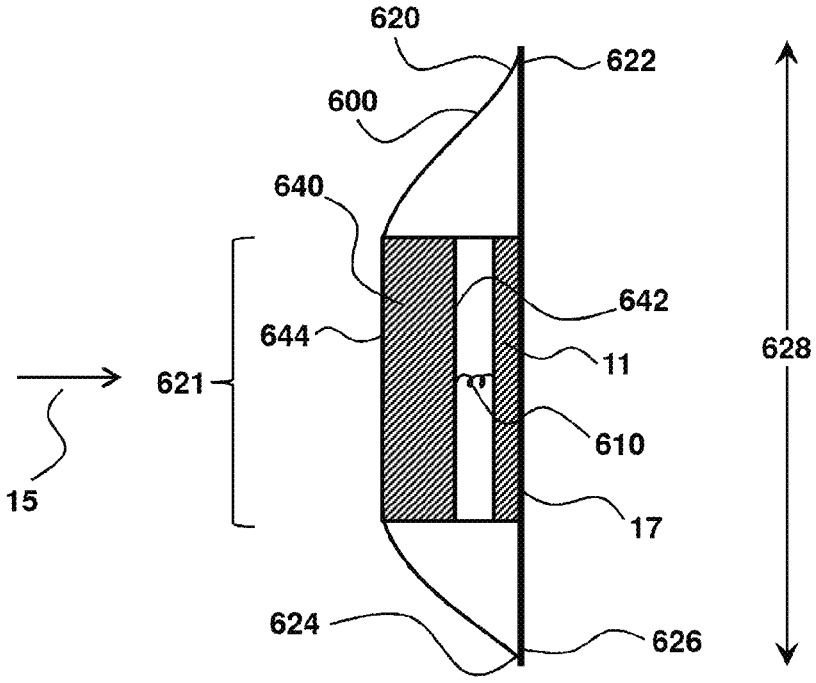
FIG. 6 illustrates an adhesive tape and spring configuration for securing a hearing device against the skull.

FIGS. 5-6 illustrate an embodiment where the adhesive anchor 5 comprises an adhesive element and a spring-like element. FIG. 5 shows adhesive anchor 5 comprising an adhesive 500 connected to a cantilever 510 at a cantilever first end 512. A cantilever second end 514 is operably connected to the external component 20 to generate normal force 15 to secure external component 20 against user surface 17. In this example, the second end 514 is positioned against an outer facing surface 12 of the external component 20 to exert a normal securing force 15. Alternatively, the second end 514 may be positioned against another surface, such as the top, bottom, side, or combinations thereof, to generate a normal force. One advantage of the connection to the surface 12 is that unbalanced forces or torques are readily minimized or avoided, force is better distributed across the contact surface area, and undesirable pressure points avoided. In an aspect, the external component has an inner-facing surface that is shaped or curved for conformal contact with the user surface 17 having a corresponding shaped or curved surface, thereby further reducing the risk of discomfort and unwanted pressure points.

FIG. 6 is an embodiment where the adhesive anchor comprises an adhesive 600 and a spring 610. In contrast to the embodiment of FIG. 5 where a cantilever 510 secured by an adhesive 500 generates the normal force, the embodiment of FIG. 6 relies on a tension generated by adhesive 600 to in turn generate a normal force that is transmitted via a spring 610 to the transducer 11 portion of the external component that is secured against the user surface 17. The adhesive 600 may be an adhesive tape having a first end 620 secured to a first position 622 of user surface 17 and a second end 624 secured to a second position 626 of user surface 17. The first 622 and second 626 positions are separated by a separation distance 628. The adhesive tape 600 has a central portion 621 between the ends 620 and 624, more specifically defined by the portion in contact with the external component 20 to provide the securing normal force 15. In an embodiment, the percentage length of the adhesive tape central portion is selected from a range that is between about 30% and 60%. In an embodiment, the central portion 621 contacts the external component 20 at an external housing assembly 640. The external housing assembly has a first surface 642 connected to the spring element 610 and a second surface 644 connected to the central portion 621 of the adhesive tape 600. Any number of individual spring elements 610 may be used to provide good and uniform force transmission of the force exerted on the surface 644 to the force exerted against the user surface 17. In an embodiment, an inner surface of the external component in contact with the user surface 17 is correspondingly shaped to the shape of the user surface so as to avoid unwanted pressure points and to increase comfort. In an aspect, the shape of inner surface of the external component is tailored to the individual user, such as by obtaining a mold of the user surface and forming the inner surface of the external component with the mold.

The adhesive 600 can be any material known in the art that reversibly adheres to a user surface 17, specifically skin overlying the region to which the hearing device is desirably affixed. In an aspect, the adhesive is an adhesive tape, such as medical tape or surgical tape (e.g., 3M Micropore™ or Transpore® Surgical Tape). Alternatively, the adhesive can 600 can be a fastener-type system that reversibly mates to a counterpart, such as by snap-fit, Velcro® straps and the like, so that the device can be reversibly connected to the user. In an aspect, the portion of the anchor connected to the hearing device external component can be more permanently connected with the ends of the anchor connected to the user configured to be reversibly removed. Alternatively, the adhesive anchor portion may be reversibly connected to the external component so that the external component may be removed from the adhesive anchor.

In an aspect, the adhesive anchor comprises adhesive tape having a defined geometry. In an embodiment, the shape is generally rectangular with two defined ends. Alternatively, other shapes may be used, such as to provide increased contact with the user surface. One example is adhesive tape having an outer edge perimeter that is sticky to contact the user surface. Such a shape can be circular, oval, elliptical or rectangular that covers the external component, such as 640 and 11 of FIG. 6. In an embodiment, the adhesive anchor is further defined as having an adhesive contact area with the user surface, such as a contact surface area selected from a range that is greater than or equal to 1 $cm^2$ and less than or equal to 10 $cm^2$.

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

All patents and publications mentioned in the specification are indicative of the levels of skill of those skilled in the art to which the invention pertains. References cited herein are incorporated by reference herein in their entirety to indicate the state of the art, in some cases as of their filing date, and it is intended that this information can be employed herein, if needed, to exclude (for example, to disclaim) specific embodiments that are in the prior art. For example, when a compound is claimed, it should be understood that compounds known in the prior art, including certain compounds disclosed in the references disclosed herein (particularly in referenced patent documents), are not intended to be included in the claim.

One skilled in the art readily appreciates that the present invention is well adapted to carry out the objects and obtain the ends and advantages mentioned, as well as those inherent in the present invention. The methods, components, materials and dimensions described herein as currently representative of preferred embodiments are provided as examples and are not intended as limitations on the scope of the invention. Changes therein and other uses which are encompassed within the spirit of the invention will occur to those skilled in the art, are included within the scope of the claims.

Although the description herein contains certain specific information and examples, these should not be construed as limiting the scope of the invention, but as merely providing illustrations of some of the embodiments of the invention. Thus, additional embodiments are within the scope of the invention and within the following claims.

Whenever a range is given in the specification, for example, a temperature range, a time range, a distance range, a surface area range, a percentage range, or a force range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

REFERENCES

Holgers et al. Soft tissue reactions around reactions around percutaneous implants: a clinical study of soft tissue conditions around skin-penetrating titanium implants for bone-anchored hearing aids. American Journal of Otology 1988 January; 9(1):56-9.

McDermott, A. L., et al., The birmingham pediatric bone-anchored hearing aid program: a 15-year experience. Otol Neurotol, 2009. 30(2): p. 178-83.

Lloyd, S., et al., Updated surgical experience with bone-anchored hearing aids in children. J Laryngol Otol, 2007. 121(9): p. 826-31.

Monksfield, P., et al., Experience with the longer (8.5 mm) abutment for Bone-Anchored Hearing Aid. Otol Neurotol, 2009. 30(3): p. 274-6.

van de Berg, R., et al., *Bone-anchored hearing aid: a comparison of surgical techniques*. Otol Neurotol, 2010. 31(1): p. 129-35.

Stalfors, J. and A. Tjellstrom, Skin reactions after BAHA surgery: a comparison between the U-graft technique and the BAHA dermatome. Otol Neurotol, 2008. 29(8): p. 1109-14.

de Wolf, M. J., et al., Nijmegen results with application of a bone-anchored hearing aid in children: simplified surgical technique. Ann Otol Rhinol Laryngol, 2008. 117(11): p. 805-14.

Wazen, J. J., et al., *Successes and complications of the Baha system*. Otol Neurotol, 2008. 29(8): p. 1115-9.

Priwin, C. and G. Granstrom, The bone-anchored hearing aid in children: a surgical and questionnaire follow-up study. Otolaryngol Head Neck Surg, 2005. 132(4): p. 559-65.

Badran, K., et al., Long-term complications of bone-anchored hearing aids: a 14-year experience. J Laryngol Otol, 2009. 123(2): p. 170-6.

de Wolf, M. J., et al., Bone-anchored hearing aid surgery in older adults: implant loss and skin reactions. Ann Otol Rhinol Laryngol, 2009. 118(7): p. 525-31.

Faber, H. T., et al., *Bone-anchored hearing aid implant location in relation to skin reactions*. Arch Otolaryngol Head Neck Surg, 2009. 135(8): p. 742-7.

I claim:

1. A system for transmitting vibrations from an externally mounted hearing aid to a users skull, the system comprising:

an external component surface, and a self-adhesive anchor for reversibly securing said external component surface to a surface of the user that overlays a mastoid region;

wherein in use said external component surface and said self-adhesive anchor connected to the mastoid region generates a normal force distribution, said normal force distribution having an outer region with a force direction that is away from the mastoid region and a central region with a force direction that is toward the mastoid region, said central region providing sufficient contact force between the external component surface and the mastoid region to reliably transmit vibration from the external hearing aid to the mastoid region wherein the self-adhesive anchor comprises a retainer pad having a top surface and a bottom surface, a top adhesive layer for connecting the retainer pad to the external component surface, and a bottom adhesive layer for connecting the retainer pad to the mastoid region;

wherein the self-adhesive anchor has a physical property selected from one or more of a thickness selected from a range that is greater than or equal to 0.1 mm and less than or equal to 5 mm, and a net bending stiffness that that provides an outer end deflection value selected from a range of 0.08" to 0.25" under an applied load of about 0.8 lbf to 2.5 lbf to the outer end, and further wherein the applied load is generated by the bottom adhesive layer connected to a curved surface that correspondingly curves the retainer pad.

2. The system of claim 1, wherein the self-adhesive anchor comprises an adhesive layer between the surface of the user and the external component surface, and the adhesive layer is shaped for conformal contact with and to cover a portion of the mastoid region.

3. The system of claim 1, wherein the external component surface is a contact pad having a flat surface for connection to the self-adhesive anchor, and an opposably positioned surface vibrationally connected to a vibrator of the hearing aid device.

4. The system of claim 3, wherein the flat surface has a surface shape that is substantially circular.

5. The system of claim 4, wherein the surface shape has an average diameter selected from a range that is greater than or equal to 1 cm and less than or equal to 5 cm.

6. The system of claim 3, wherein the self-adhesive anchor comprises an adhesive layer having a surface shape and surface area that corresponds to a surface shape and surface area of the contact pad flat surface.

7. The system of claim 1, wherein the retainer pad is shaped for placement behind the ear, the retainer pad shape having a concave edge for positioning closest to an ear and a convex edge opposed to the concave edge for positioning furthest from an ear.

8. The system of claim 7, wherein the top adhesive layer has a top adhesive layer surface shape, the retainer pad further comprising a boss feature having a boss feature shape corresponding to the top adhesive layer surface shape for receiving the top adhesive layer.

9. The system of claim 1, wherein the retainer pad and bottom adhesive layer each have a surface shape that corresponds to each other.

10. The system of claim 1, wherein the retainer pad has a surface area and the external component surface has a surface area, wherein a surface area ratio of the retainer pad to external component surface is selected from a range that is greater than or equal to 1 and less than or equal 5.

11. The system of claim 1, wherein the applied load is selected from a range that is greater than or equal to 1 lbf and less than or equal to 2 lbf.

12. The system of claim 2, wherein the adhesive layer is two-sided removable medical adhesive.

13. A self-adhesive hearing aid pad for connecting a hearing aid to a user surface comprising:

a conformable retainer pad having a top surface and a bottom surface;

a top adhesive layer that is connected to the retainer pad top surface for connecting the retainer pad to an external component surface of the hearing aid;

a bottom adhesive layer connected to the retainer pad bottom surface for connecting the retainer pad to the user surface, and a boss feature for receiving and positioning the top adhesive layer on the retainer pad top surface;

wherein the retainer pad conforms to a curvature of the user surface during use by deflection of an outer portion relative to an inner portion to generate an upward directed force along an outer edge of the retainer pad and a downward directed force within an inner region to provide good contact between the conformable retainer pad and the user surface;

wherein the self-adhesive anchor has a physical property selected from one or more of a thickness selected from a range that is greater than or equal to 0.1 mm and less than or equal to 5 mm, and a net bending stiffness that that provides an outer end deflection value selected from a range of 0.08" to 0.25" under an applied load of about 0.8 lbf to 2.5 lbf to the outer end, and further wherein the applied load is generated by the bottom adhesive layer connected to a curved surface that correspondingly curves the retainer pad.

14. The self-adhesive hearing aid pad of claim 13, wherein the top adhesive layer is connected to an external component surface of a hearing aid.

15. The self-adhesive hearing aid pad of claim 14, having a surface area selected from a range of 1 $cm^2$ and 15 $cm^2$, and the surface area is available for physical contact with skin overlying a mastoid region.

16. A method of securing a bone conducting hearing device to skin overlaying a mastoid region of a user, said method comprising the steps of:

positioning an adhesive anchor on skin overlaying the mastoid region of the user;

connecting a bone conducting hearing device to the adhesive anchor;

generating an outer directed force in skin positioned beneath an outer portion of the adhesive anchor; and counterbalancing the outer directed force with an inward directed force in skin positioned beneath an inner portion of the adhesive anchor, and deforming the adhesive anchor to conform to the shape of the mastoid beneath the adhesive anchor, thereby generating the outer directed force, wherein the inward directed force reliably secures the bone conducting hearing device to the user.

* * * * *